US006065421A

United States Patent [19]

Haller et al.

[11] Patent Number: 6,065,421

[45] Date of Patent: May 23, 2000

[54] INFLATABLE KAYAK

[75] Inventors: Clayton Forbes Haller, Martinez; Charles Prior Hall, Santa Rosa, both of Calif.

[73] Assignee: Stearns, Inc., St. Cloud, Mo.

[21] Appl. No.: 09/165,038

[22] Filed: Oct. 1, 1998

[51] Int. Cl.[7] ..... B63B 35/00

[52] U.S. Cl. ..... 114/347; 114/345

[58] Field of Search ..... 114/343, 345, 114/347

[56] References Cited

U.S. PATENT DOCUMENTS

| | | | |
|---|---|---|---|
| 1,419,464 | 6/1922 | Meyer . | |
| 1,555,080 | 9/1925 | Scheibert . | |
| 1,631,047 | 5/1927 | Meyer . | |
| 2,999,253 | 9/1961 | Lewis | 114/347 |
| 3,150,386 | 9/1964 | Bastien . | |
| 3,359,579 | 12/1967 | Reffell et al. . | |
| 3,935,607 | 2/1976 | Cantwell et al. . | |
| 4,057,865 | 11/1977 | Trautwein . | |
| 4,750,446 | 6/1988 | Sussman . | |
| 4,782,777 | 11/1988 | Sussman . | |
| 4,864,960 | 9/1989 | Sansoucy | 114/347 |
| 5,046,978 | 9/1991 | Howerton . | |
| 5,304,082 | 4/1994 | Wolfe . | |
| 5,358,438 | 10/1994 | Wolfe . | |
| 5,564,357 | 10/1996 | Peterson . | |
| 5,732,650 | 3/1998 | Peterson . | |

*Primary Examiner*—Stephen Avila
*Attorney, Agent, or Firm*—Flehr Hohbach Test Albritton & Herbert LLP

[57] ABSTRACT

Inflatable kayak having a pneumatically inflatable peripheral tube with elongated side sections which come together fore and aft to form a passenger compartment, a flexible cover encasing the tube and forming a shell against which the tube can be inflated to form a relatively rigid structure. A sheet of tarpaulin material extends across the bottom of the passenger compartment and along the lower and outer sides of the tube, and an inflatable floor cushion rests on the tarpaulin material in the passenger compartment. A seat is provided toward the rear of the passenger compartment, and a splash skirt attached to the cover extends across the passenger compartment between the side sections of the tube in front of the seat.

19 Claims, 5 Drawing Sheets

INFLATABLE KAYAK

This invention pertains generally to kayaks and, more particularly, to an inflatable kayak which can be rolled up and folded for transportation and storage.

Heretofore, kayaks have been constructed in a number different ways. Older kayaks typically had rigid frames covered with skins, while newer ones have been molded of fiberglass or other rigid plastic materials. Others have been made of buoyant materials such as plastic foam as described in U.S. Pat. No. 3,150,386. A foldable kayak having a hinged frame with inflatable tubes for tightening a skin on the frame is disclosed in U.S. Pat. No. 4,057,865.

An inflatable boat having rigid bow and stern sections attached to an inflatable tube to form a canoe-like structure is shown in U.S. Pat. Nos. 1,555,080, 1,631,047. Other examples of inflatable boats are found in U.S. Pat. Nos. 1,419,545, 3,359,579, 3,935,607, 4,057,865, 5,046,978, and 5,564,357. Inflatable boats having multiple chambers for added safety are shown in U.S. Pat. Nos. 4,750,446, 4,782,777 and 5,304,082.

Some inflatable kayaks have also been available commercially from companies such as Aire Inflatables in Boise, Id. Such kayaks have been relatively expensive and have also had other limitations and disadvantages.

It is in general an object of the invention to provide a new and improved inflatable kayak.

Another object of the invention is to provide an inflatable kayak of the above character which overcomes the limitations and disadvantages of the kayaks and other inflatable boats heretofore provided.

These and other objects are achieved in accordance with the invention by providing an inflatable kayak having a pneumatically inflatable peripheral tube with elongated side sections which come together fore and aft to form a passenger compartment, a cover of flexible material encasing the tube and forming a substantially inelastic skin against which the tube can be inflated to form a relatively rigid structure, and a sheet of material more durable than the cover spanning beneath the passenger compartment and extending along the lower and outer sides of the tube and cover to form a floor for the passenger compartment and a protective sheath for the tube and cover. A splash skirt of flexible material is attached to the cover and extends between the side sections of the tube over the forward portion of the passenger compartment.

Figure 1:
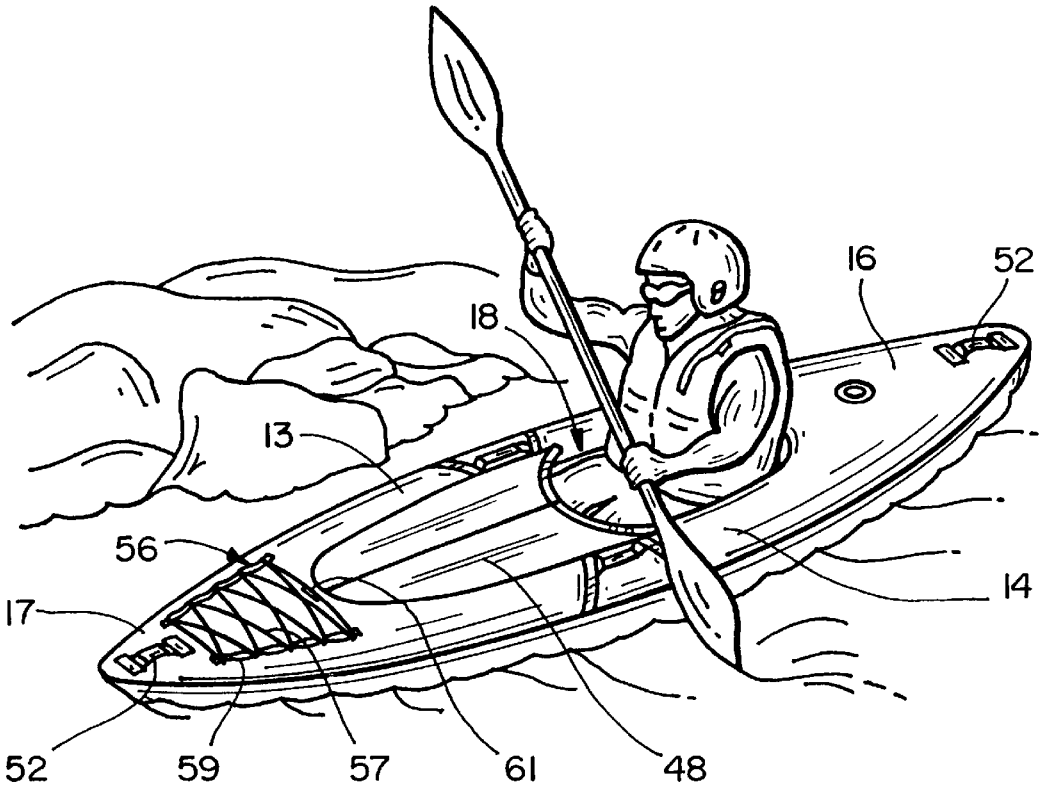
FIG. 1 is an isometric view of one embodiment of a one-man inflatable kayak incorporating the invention.

In the embodiment of FIG. 1, the kayak includes a pneumatically inflatable tube 11 which is fully encased in a flexible cover 12. The tube has elongated side sections 13, 14 of generally circular cross-section, which come together fore and aft in a stem section 17 and a stern section 16. The tube thus defines an open passenger compartment 18 which is surrounded by a single, continuous buoyancy chamber 19.

The tube is fabricated of a material such as polyvinyl chloride (PVC) or polyurethane, and the cover is fabricated of a substantially inelastic material such as nylon. The cover serves as a skin against which the tube can be inflated to form a relatively rigid structure which does not sag like other inflatable boats tend to do.

The cover wraps around the tube and is secured by a zipper 21 which extends around the entire inner periphery of the tube. In one presently preferred embodiment, the two ends of the zipper are located toward the front of the boat, the zipper has two sliders which can be hooked together when the zipper is closed so that it will not be forced open by the pressure within the tube.

A valve 23 for inflation and deflation of the tube is located in the stern section of the tube and extends through an opening 24 in the cover on the upper side of the section. In one currently preferred embodiment, this valve is a Boston valve, but any other suitable type of valve can be used.

A sheet of tarpaulin material 26 spans beneath the passenger compartment and extends along the lower and outer sides of the tube and cover. This sheet is fabricated of a much more durable material than the nylon cover, and it serves as a protective sheath for the tube and cover as well as forming a floor for the passenger compartment. In one presently preferred embodiment, the tarpaulin is an 80 gauge nylon-reinforced material, the cover is an 840D coated nylon, and the tube is fabricated of 30 gauge PVC.

Figure 2:
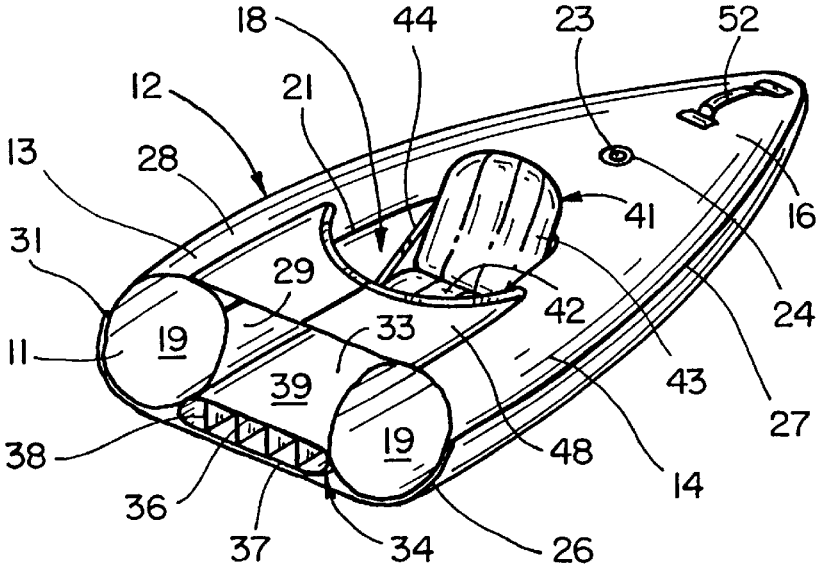
FIG. 2 is a fragmentary isometric view of the embodiment of FIG. 1.
Figure 3:
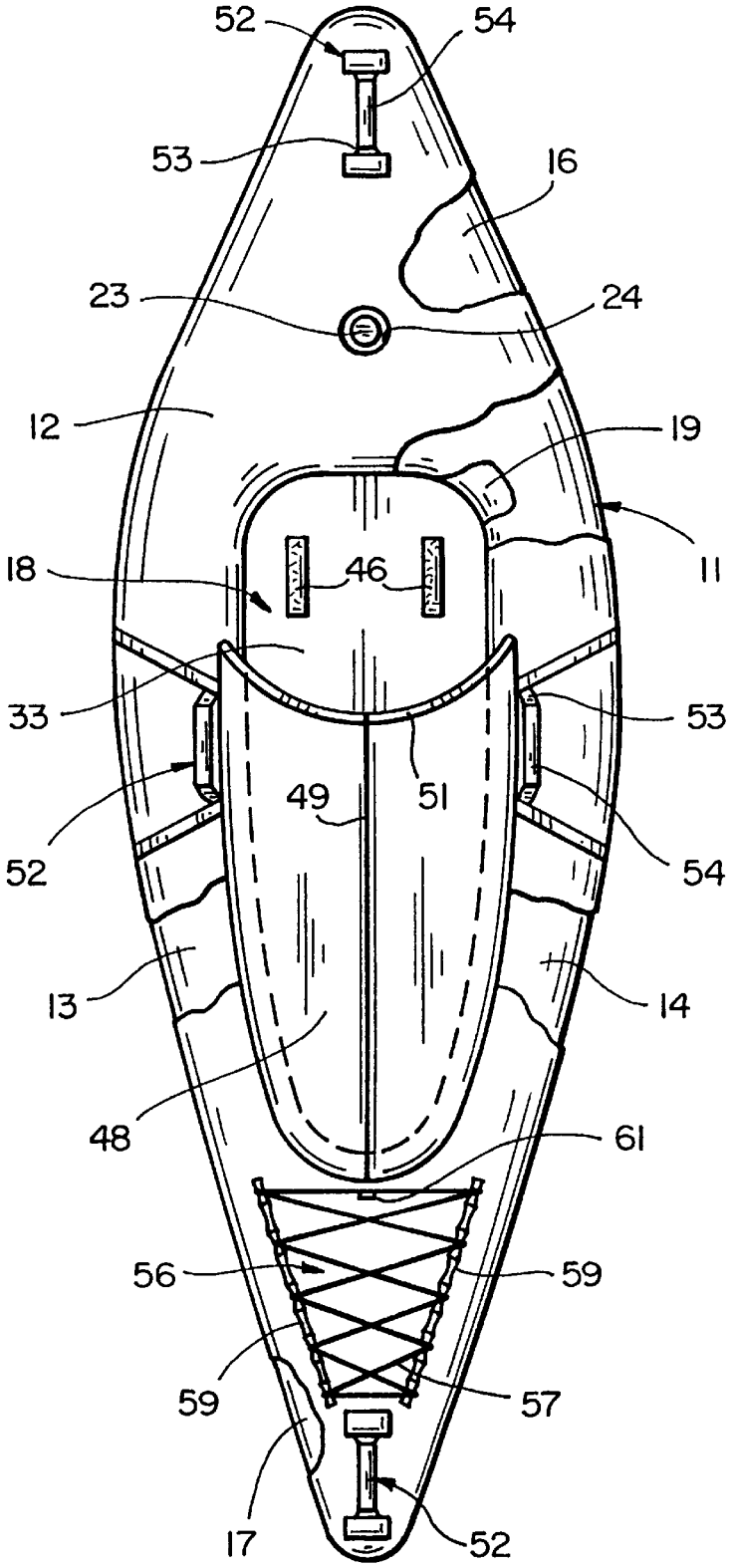
FIG. 3 is a top plan view, partly broken away, of the embodiment of FIG. 1, with the seat removed for clarity of illustration.

The tarpaulin sheet extends to a point about midway up the outer side of the tube where it is attached to the nylon cover by a peripheral seam 27. As illustrated in FIG. 2, the cover is formed in two parts—an upper section 28 which extends upwardly from the seam around the upper portion of the outer side and the top of the tube to the zipper, and a lower section 29 which extends downwardly from the seam around the lower portion of the outer side, under the tube, and up around the inner side of the tube to the zipper. The edge portions of the two cover sections and the tarpaulin sheet are stitched together, and a binding tape 31 covers the edges to give the seam a finished appearance.

A pneumatically inflated floor cushion 33 is provided in the passenger compartment. This cushion rests on the floor of the compartment, with its peripheral edges extending beneath the inner portion of the tube to hold the cushion in place. The cushion includes an inflatable bladder 34 which has a top wall 36, a bottom wall 37 and a plurality of I-beam baffles 38 which extend longitudinally and are attached to the two walls. The bladder is encased within a flexible cover 39 which, like cover 12, serves as a rigid skin against which the bladder can be inflated to form a rigid structure. In, one presently preferred embodiment, the bladder is fabricated of PVC, and the cover is fabricated of nylon.

A foldable seat 41 is removably mounted in the rear portion of the passenger compartment. This seat has a base 42 and a back rest 43 which are hinged together, with a strap 44 connected between them for adjusting the angle of the back rest relative to the base. The seat is attached to the floor cushion by Velcro fasteners 46 on the upper side of the cushion and the lower side of the base. The Velcro fasteners on the floor cushion are in the form of longitudinally extending strips which permit the position of the seat to be adjusted in accordance with the size of the person using the kayak.

If desired, the seat can be removed, and the person using the kayak can sit directly on the floor cushion and lean against the tube at the rear of the passenger compartment.

A splash skirt 48 is provided toward the front of the passenger compartment to keep water out of the compartment. The splash skirt is stitched to cover 12 along the upper inner periphery of tube 11 and covers the portion of the compartment in front of the seat. The splash skirt is split into two sections which are joined together along the longitudinal centerline of the boat by a zipper 49. A raised bead 51 extends along the rear edge of the skirt to prevent water from dripping into the passenger compartment from the skirt.

Handles 52 are provided fore and aft, and at the sides of the passenger compartment, for lifting the kayak into and out of the water, and for carrying it about. Each of these handles consists of a strap 53 of nylon or other suitable material which is stitched to the tube cover, and a grip 54 of rubber or other material which is molded onto the strap.

A tie-down area 56 is provided toward the front of the kayak for holding objects on the boat. The tie-down consists of an elastic cord 57 which is laced back and forth between loops formed by straps 59 stitched intermittently to cover 12 along opposite sides of the bow. The free ends of the cord pass through a barrel lock 61 which permits the cord to be tightened or loosened as desired.

Figure 4:
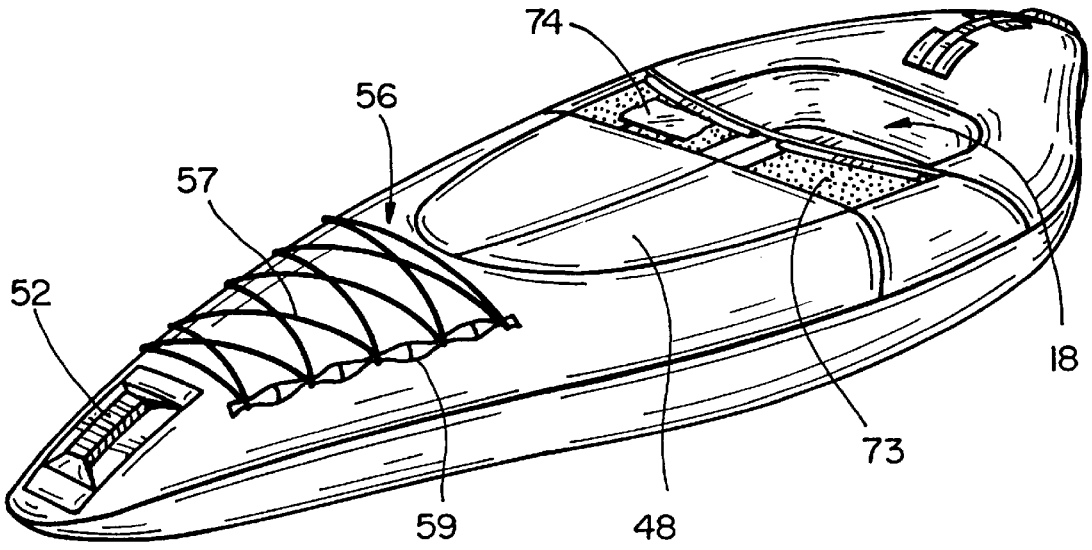
FIG. 4 is an isometric view of another embodiment of a one-man inflatable kayak incorporating the invention.
Figure 5:
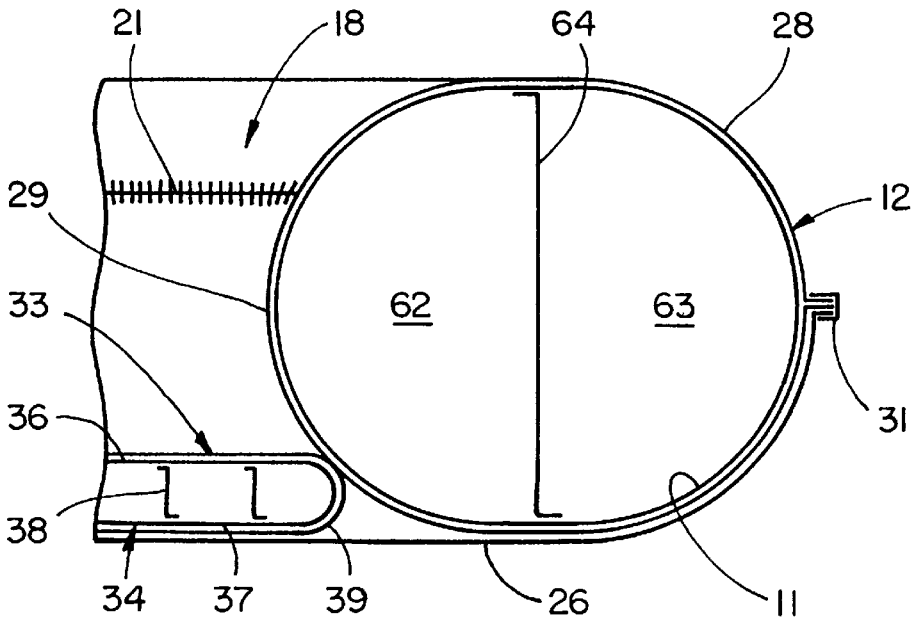
FIG. 5 is a fragmentary cross-sectional view of the embodiment of FIG. 4.
Figure 6:
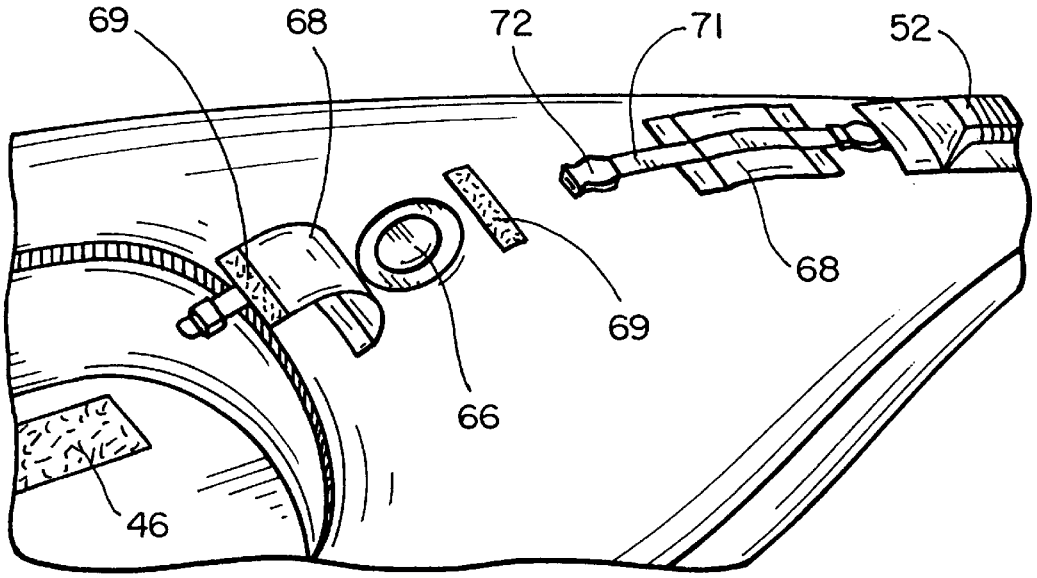
FIGS. 6 and 7 are fragmentary isometric views of the embodiment of FIG. 4.
Figure 7:
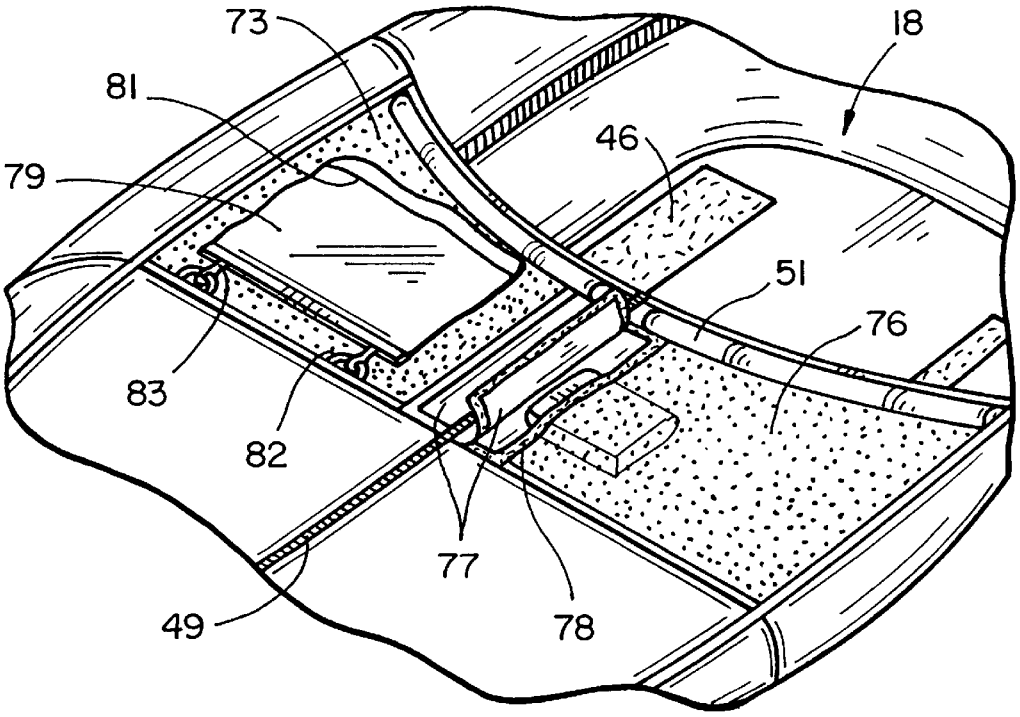

The embodiment of FIG. 4 is similar to that of FIG. 1, and like reference numerals designate corresponding elements in the two embodiments. In the embodiment of FIG. 4, tube 11 is divided into two concentric buoyancy chambers 62, 63 by a vertically extending baffle 64 which runs throughout the tube. This provides an extra safety feature in that if one of the chambers should lose pressure, the other can remain inflated and have enough buoyancy to keep the kayak afloat.

Separate valves 66 are provided for the two chambers. Each of these valves is similar to valve 23, and they are located in the upper wall of the stem portion of the tube, as in the embodiment of FIG. 1. In this embodiment, however, they are covered by flaps 68 which are held closed by Velcro fasteners 69 and straps 71 with buckles 72.

This embodiment also differs from the embodiment of FIG. 1 in that storage pockets 73 and a map holder 74 are mounted on splash skirt 48. The pockets are formed by sheets of mesh 76 which are attached to the splash skirt along three sides of each section by binding tape and stitching, with a flap 77 and a Velcro fastener 78 along the fourth side. The map holder comprises a clear plastic bag 79 which has a zipper 81 along one edge thereof. The bag is attached to one section of the skirt by D-rings 82 and clips 83.

If desired, a foldable seat similar to seat 41 can be installed in the rear portion of the passenger compartment 18 of the embodiment of FIG. 4 as in the embodiment of FIG. 1. Alternatively, the seat can be omitted, as shown, and the person using the kayak can sit directly on floor cushion 33 and lean against the tube at the rear of the passenger compartment.

Figure 8:
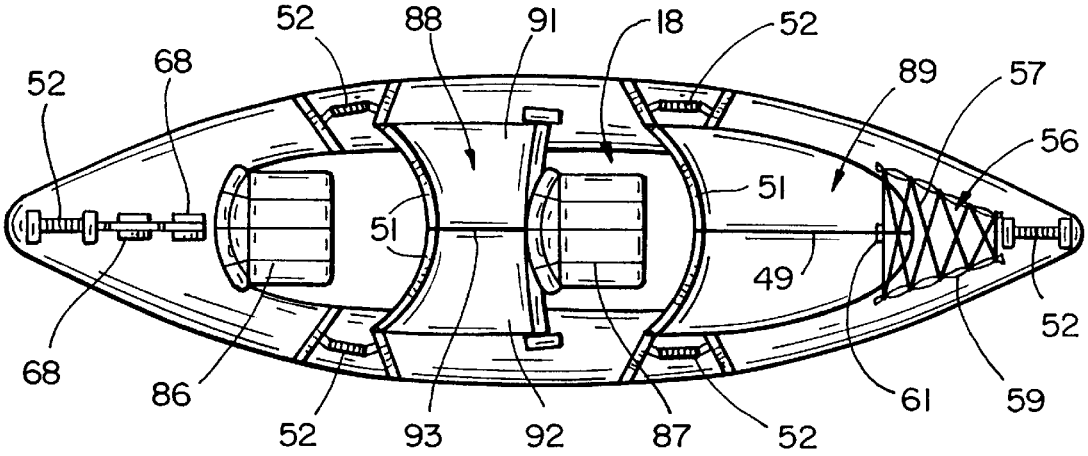
FIG. 8 is a top plan view, partly broken away, of one embodiment of a two-man inflatable kayak incorporating the invention.
Figure 9:
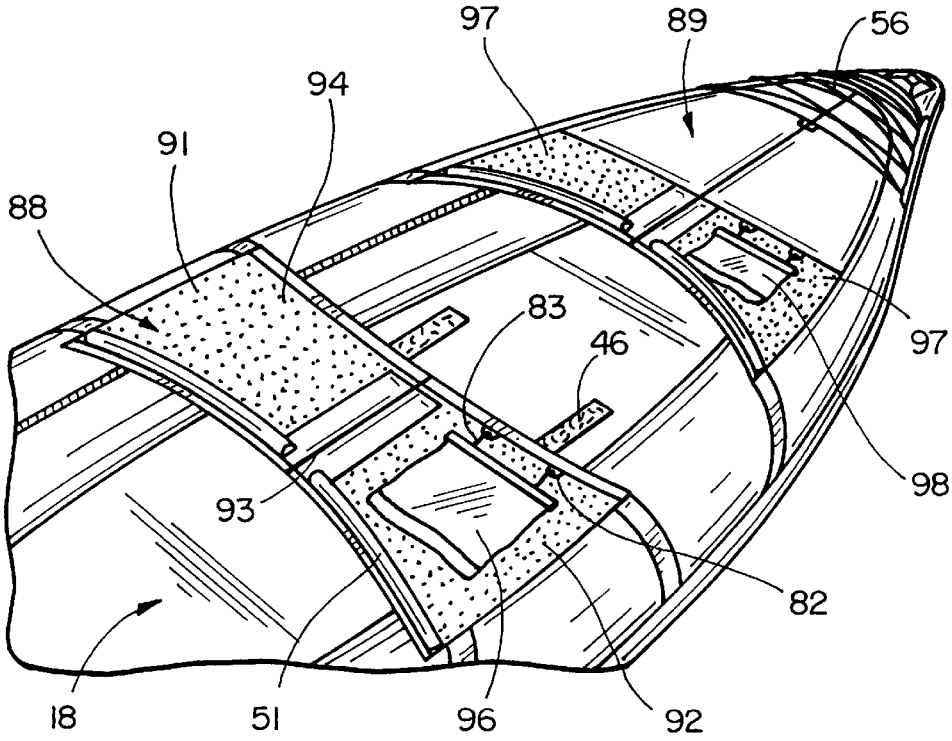
FIG. 9 is a fragmentary isometric view of the embodiment of FIG. 8, with the seats removed for clarity of illustration.

FIG. 8 illustrates a two-man kayak which is similar to the other embodiments, with like reference numerals once again designating corresponding elements in it. This embodiment differs from the others in that it has two seats 86, 87 and two splash skirts 88, 89. Seat 86 is located in the rear of the passenger compartment, with splash skirt 88 in front of it. Seat 87 is located in front of splash skirt 88, with splash skirt 89 in front of it. Seats 86, 87 are both similar to seat 41, and they are attached to floor cushion 33 by Velcro fasteners 46.

Splash skirt 88 is formed in two sections 91, 92, with a zipper 93 between them, and has mesh pockets 94 similar mesh pockets 73 and a map holder 96 similar to map holder 74. Splash skirt 89 is similar to splash skirt 48, and has storage pockets 97 and a map holder 98.

If desired, rear seat 86 can be removed, and the person in the rear of the boat can sit directly on the floor cushion and rest against the tube at the rear of the passenger compartment. Front seat 87 can also be removed, and the person in the front of the boat can rest to some extent against the splash skirt behind him.

Operation and use of all three of the disclosed embodiments is similar. In each case, tube 11 is inserted into cover 12, and floor cushion 33 is tucked into the passenger compartment before the tube is inflated. The floor cushion is inflated first, and then the tube is inflated around it. If used, the foldable seat(s) is (are) then installed and adjusted, and the kayak is ready for launching.

For transportation and storage, the tube and the floor cushion are deflated, and the kayak is rolled up or folded. If desired, it can be placed in a bag (not shown) which is easily carried by one person. A collapsible paddle, safety equipment (e.g., life vest, helmet and goggles), and a pump can also be stored and carried in the same bag.

The invention has a number of important features and advantages. The kayak is light in weight (about 25 pounds or less) and is readily transported and stored. It is extremely durable, and the stiffness provided by inflating the tube against the nylon cover gives the kayak a solid feel and makes it handle unusually well. It is more buoyant that a molded kayak, and can be manufactured more economically and sold for a lower price than inflatable kayaks of the prior art.

It is apparent from the foregoing that a new and improved inflatable kayak has been provided. While only certain presently preferred embodiments have been described in detail, as will be apparent to those familiar with the art, certain changes and modifications can be made without departing from the scope of the invention as defined by the following claims.

What is claimed is:

1. In an inflatable kayak: a pneumatically inflatable peripheral tube having elongated side sections which come together fore and aft to form a passenger compartment surrounded by a single, continuous buoyancy chamber, a cover of flexible material encasing the tube and forming a substantially inelastic skin against which the tube can be inflated to form a relatively rigid structure, and a sheet of material more durable than the cover spanning beneath the passenger compartment and extending along the lower and outer sides of the tube and cover to form a floor for the passenger compartment and a protective sheath for the tube and cover.

2. The inflatable kayak of claim 1 wherein the cover wraps about the side sections of the tube and is secured about the tube by a zipper which extends around the inner periphery of the tube.

3. The inflatable kayak of claim 1 further including an inflatable floor cushion resting on the sheet of more durable material beneath the passenger compartment.

4. The inflatable kayak of claim 3 wherein the floor cushion comprises a pneumatically inflatable bladder encased in a cover of flexible material against which the bladder can be inflated.

5. The inflatable kayak of claim 4 wherein the bladder has horizontally extending upper and lower walls, and a plurality of vertically extending baffles connected between the walls.

6. The inflatable kayak of claim 1 wherein the sheet which spans beneath the passenger compartment is a tarpaulin material.

7. The inflatable kayak of claim 1 including a foldable seat mounted in the passenger compartment.

8. The inflatable kayak of claim 1 including a splash skirt of flexible material attached to the cover and extending between the side sections of the tube over the forward portion of the passenger compartment.

9. The inflatable kayak of claim 6 wherein the splash skirt is formed in two sections, with a zipper extending along adjacent edges of the two sections for joining the two sections together.

10. The inflatable kayak of claim 1 including a second pneumatically inflatable tube disposed concentrically of the first named tube to provide a second buoyancy chamber for keeping the kayak afloat.

11. An inflatable kayak, comprising a pneumatically inflatable peripheral tube having elongated side sections which come together fore and aft to form a passenger compartment, a flexible cover encasing the tube and forming a shell against which the tube can be inflated to form a relatively rigid structure, a sheet of tarpaulin material extending across the bottom of the passenger compartment and along the lower and outer sides of the tube and cover to form a floor for the passenger compartment and a protective sheath for the tube and cover, an inflatable floor cushion resting on the tarpaulin material in the passenger compartment, a seat toward the rear of the passenger compartment, and a splash skirt attached to the cover and extending across the passenger compartment between the side sections of the tube in front of the seat.

12. The inflatable kayak of claim 11 wherein the tube forms a single, continuous buoyancy chamber which surrounds the passenger compartment.

13. The inflatable kayak of claim 11 including an internal wall which divides the tube into a pair of buoyancy chambers which surround the passenger compartment.

14. The inflatable kayak of claim 11 wherein the seat is a foldable seat which is attached to the floor cushion by a loop and pile fastener that permits the position of the seat to be adjusted longitudinally within the passenger compartment.

15. The inflatable kayak of claim 11 wherein the seat has back rest and seat portions which are hingedly connected together, with a strap connected to the two portions for adjusting the angle between them.

16. The inflatable kayak of claim 11 including a second seat in front of the splash skirt, and a second splash skirt attached to the cover and extending across the top of the passenger compartment in front of the second seat.

17. The inflatable kayak of claim 11 wherein the cover wraps about the side sections of the tube and is secured about the tube by a zipper which extends around the inner periphery of the tube.

18. An inflatable kayak, comprising a pneumatically inflatable peripheral tube having elongated side sections which come together fore and aft to form a passenger compartment, a flexible cover encasing the tube and forming a shell against which the tube can be inflated to form a relatively rigid structure, a sheet of tarpaulin material extending across the bottom of the passenger compartment and along the lower and outer sides of the tube and cover to form a floor for the passenger compartment and a protective sheath for the tube and cover, and a splash skirt attached to the cover and extending across the passenger compartment between the side sections of the tube in the front portion of the passenger compartment.

19. An inflatable kayak, comprising a pneumatically inflatable peripheral tube having elongated side sections which come together fore and aft to form a passenger compartment, a flexible cover encasing the tube and forming a shell against which the tube can be inflated to form a relatively rigid structure, the cover having an upper section which extends about the upper portion of the tube and a lower section which extends about the lower portion of the tube, the outer edge portions of two sections being joined together in a seam which extends about the outer periphery of the tube and the inner edge portions of the two sections being connected together by a zipper which extends about the inner periphery of the tube, and a floor sheet which extends beneath the passenger compartment and about the lower and outer portions of the tube and is joined to the two sections of the cover in the outer peripheral seam.

* * * * *

UNITED STATES PATENT AND TRADEMARK OFFICE
CERTIFICATE OF CORRECTION

PATENT NO : 6,065,421

DATED : May 23, 2000

INVENTOR(S) : Haller et al.

It is certified that error appears in the above-identified patent and that said Letters Patent are hereby corrected as shown below:

On the title page:

item [73] Assignee:

Stearns Inc., St. Cloud, MN

Signed and Sealed this

Eighth Day of May, 2001

*Attest:*

Nicholas P. Godici

NICHOLAS P. GODICI

*Attesting Officer*

*Acting Director of the United States Patent and Trademark Office*